US007485052B2

(12) United States Patent
Matroni et al.

(10) Patent No.: US 7,485,052 B2
(45) Date of Patent: Feb. 3, 2009

(54) GOLF BALL

(75) Inventors: Gary Matroni, Agawam, MA (US); Thomas J. Kennedy, III, Wilbraham, MA (US); Viktor Keller, Beverly Hills, FL (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 11/853,944

(22) Filed: Sep. 12, 2007

(65) Prior Publication Data

US 2008/0064530 A1 Mar. 13, 2008

Related U.S. Application Data

(60) Provisional application No. 60/825,556, filed on Sep. 13, 2006.

(51) Int. Cl.
*A63B 37/12* (2006.01)

(52) U.S. Cl. ..... 473/378

(58) Field of Classification Search ..... 473/351, 473/378

See application file for complete search history.

*Primary Examiner*—Raeann Trimiew
(74) *Attorney, Agent, or Firm*—Michael A. Catania; Elaine H. Lo

(57) ABSTRACT

A low modulus durable coating layer for a polyurethane covered golf ball is disclosed herein. The coating includes a high equivalent weight polyester polyol wherein the high equivalent weight polyester polyol has an equivalent weight of at least 1000.

12 Claims, 1 Drawing Sheet

GOLF BALL

CROSS REFERENCES TO RELATED APPLICATIONS

The Present Application claims priority to U.S. Provisional Patent Application No. 60/825,556, filed on Sep. 13, 2006.

STATEMENT REGARDING FEDERALLY SPONSORED RESEARCH OR DEVELOPMENT

Not Applicable

BACKGROUND OF THE INVENTION

1. Field of the Invention

The present invention relates to a coating for a golf ball. More specifically, the present invention relates to a coating for a golf ball with a polyurethane cover.

2. Description of the Related Art

Current coatings do not have sufficient durability and processing capability for premium polyurethane covered golf balls. Especially reaction injection molded polyurethane covered golf balls.

Yoneyama, U.S. Pat. No. 6,210,695 for a Golf Ball Having Coated Surface Layer Of Polyurethane discloses a clear top coat used to form the outermost layer of a golf ball which comprises (A) a polyol component containing a polyurethane polyol which has been produced from a diisocyanate compound and a hydroxyl group-containing compound and which has urethane bonds in the main chain thereof and hydroxyl groups at the chain ends and has a hydroxyl value of 20 to 100 mgKOH/g when the non-volatile content is 100% by weight, a concentration of urethane group of 1 to 5 millimoles/g and a weight average molecular weight of 10,000 to 50,000, and (B) a yellowing resistant polyisocyanate as a hardener, wherein the NCO/OH equivalent ratio of isocyanate group in said component (B) to hydroxyl group in said component (A) is from 0.7/1.0 to 2.0/1.0.

Ohira, et al., U.S. Pat. No. 6,509,410 for an Aqueous Coating Composition For Golf Ball And Golf Ball Using The Same discloses an aqueous coating composition for golf ball, comprising: a water-soluble urethane polyol having a hydroxyl value of 100 to 300 mgKOH/g, obtained by reacting a polyol component and a polyisocyanate component, and a hydrophilic group-containing polyisocyanate. (2) An aqueous coating composition for golf ball, comprising: a water-soluble urethane polyol having a hydroxyl value of 100 to 300 mgKOH/g, obtained by reacting a polyol component and a polyisocyanate component, a water-dispersible urethane resin, and a hydrophilic group-containing polyisocyanate.

Fushihara, U.S. Pat. No. 6,713,588 for a Golf Ball, discloses a polyurethane clear coating film is made by curing a polyol with an isocyanate curing agent, wherein the polyol is a mixture of a polyester polyol and a polyether polyol.

U.S. Pat. No. 5,885,173 discloses an indicia for a golf ball and is hereby incorporated by reference in its entirety. U.S. Pat. No. 6,001,177 discloses painting system for painting a golf ball and is hereby incorporated by reference in its entirety. U.S. Pat. No. 5,300,325 discloses a method for finishing a golf ball and is hereby incorporated by reference in its entirety. U.S. Pat. No. 5,409,233 discloses a coating composition for a golf ball and is hereby incorporated by reference in its entirety. U.S. Pat. No. 5,494,291 discloses a coating composition for a golf ball and is hereby incorporated by reference in its entirety. U.S. Pat. No. 6,146,288 discloses a coating composition for a golf ball and is hereby incorporated by reference in its entirety. U.S. Pat. No. 6,245,386 discloses a method for finishing a golf ball and is hereby incorporated by reference in its entirety.

BRIEF SUMMARY OF THE INVENTION

The present invention is a low modulus coating that utilizes a high equivalent weight polyester polyol as a modifier for a polyester polyol/polyisocyanate solvent borne coatings system. The system may contain a whitening agent such as titanium dioxide. Due to the lower reactivity of the linear, high equivalent weight polyol, more catalyst (dibutyl tin dilaurate) is required to cure the coating in a reasonable processing timeframe.

The linear, high equivalent weight (low hydroxyl %) polyol is used in conjunction with lower equivalent weight (high hydroxyl %) polyester polyols. This polyol system is then crosslinked with a polyisocyanate material (polymeric isocyanate, prepolymer isocyanate) to form a tough, durable coating that has excellent adhesion to the golf ball cover.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
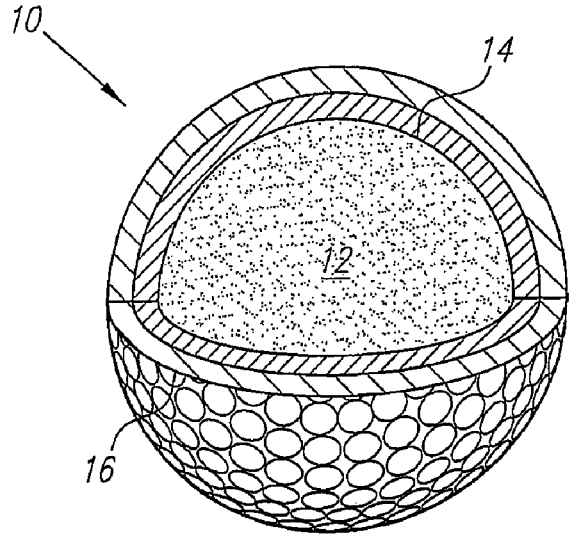
FIG. 1 shows a cross-sectional view of a multiple-layer golf ball.

A coating for a golf ball is disclosed herein. The coating is preferably used on a polyurethane covered golf ball, and more preferably a reaction injection molded polyurethane covered golf ball. The coating preferably includes a high equivalent weight polyester polyol which makes it more abrasion resistant. A preferred high equivalent weight polyester polyol is DESMOPHEN 1652A solvent-free linear saturated polyester polyol which is available from BAYER MATERIAL. The coating may also include other polyester polyols such as DESMOPHEN 670A 80 a saturated polyester polyol and DESMOPHEN 631A 75, which is another saturated polyester polyol, both available from BAYER MATERIAL. The preferred high equivalent weight polyester polyol, DESMOPHEN 1652A solvent-free linear saturated polyester polyol, has an equivalent weight of 1002. Other additives used in the coating include BYK-354 polyacrylate additive for inks available from BYK-Chemie, and SANDOVAR additive, TINUVIN 292 UV absorber, FINNTITIAN RDI titanium dioxide, T-12 additive, methyl isobutyl ketone ("MIIBK"), methyl amyl ketone ("MAK") and n-butyl acetate.

A preferred isocyanate compound is DESMODUR N-3200 aliphatic polyisocyanate available from BAYER MATERIAL, which is a hexamethylene diisocyanate; hexamethylene diisocyanate biuret, having a nitrogen-carbon-oxygen group content of approximately 23%.

One formulation has 10 parts DESMOPHEN 631A 75, 10 parts DESMOPHEN670A 80, 20 parts DESMOPHEN 1652A, 0.06 parts DABCOT-12, 0.7 parts white pigment and 196.8 parts DESMODUR 3200.

TABLE ONE

| Part A | Weight (gms) |
|---|---|
| Grind | |
| Desmophen 670A-80 | 111.03 |
| n-Butyl Acetate | 20.76 |
| Methyl Amyl Ketone | 30.75 |
| Finntitan RDI | 236.84 |
| | 399.38 |
| Letdown | |
| Desmophen 670A-80 | 46.10 |
| Desmophen 631A-75 | 23.94 |
| Desmophen 1652A | 35.92 |
| Byk 354 | 1.32 |
| T-12 | 0.34 |
| Sandovur 3206 | 1.32 |
| Tinuvin 292 | 1.32 |
| n-Butyl Acetate | 71.76 |
| Methyl Isobutyl Ketone | 66.17 |
| Methyl Amyl Ketone | 154.29 |
| Subtotal | 402.48 |
| Total | 801.86 |

TABLE TWO

| Part B | |
|---|---|
| MIBK | 118.86 |
| Desmodur N-3200 | 83.58 |
| | 202.44 |
| Mix Ratio (by weight) | 0r 3 to 1 by Volume |
| Part A - 160 grams | WPG - Part A 9.97 |
| Part B - 40 grams | WPG - Part B 7.55 |

TABLE THREE

| Material | Weight | Volume | TNV |
|---|---|---|---|
| Part A | | | |
| Desmophen 670A80 | 298.55 | 32.45 | 238.84 |
| Desmophen 1652A | 68.24 | 6.96 | 68.24 |
| Desmophen 631A75 | 45.49 | 4.94 | 34.12 |
| Catafor CA-100 | 2.61 | 0.33 | 2.61 |
| Byk 370 | 20.44 | 2.67 | 5.11 |
| FC-430 | 1.04 | 0.11 | 1.04 |
| Dabco T-12 | 1.14 | 0.12 | 1.14 |
| Sandover 3206 | 2.48 | 0.29 | 2.48 |
| Tinuvin 292 | 2.48 | 0.30 | 2.48 |
| Uvitex OB | 0.35 | 0.03 | 0.35 |
| Butyl Acetate | 99.64 | 13.58 | 0.00 |
| MAK | 168.51 | 24.78 | 0.00 |
| Sub Total | 710.97 | 86.56 | 356.41 |

TABLE FOUR

| Part B | | | |
|---|---|---|---|
| Desmodur N-3200 | 158.80 | 17.08 | 158.80 |
| MIBK | 174.63 | 26.17 | 0.00 |
| Sub Total | 333.43 | 43.25 | 158.80 |
| Total | 1044.40 | 129.81 | 515.21 |

TABLE FOUR-continued

| PROPERTIES: | | | |
|---|---|---|---|
| Wt/gal | Part A 8.21 lbs.<br>Part B 7.71 lbs.<br>A/B 8.04 lbs. | TNV | Part A 50.13%<br>Part B 47.63%<br>A/B 49.33% |

Figure 2:
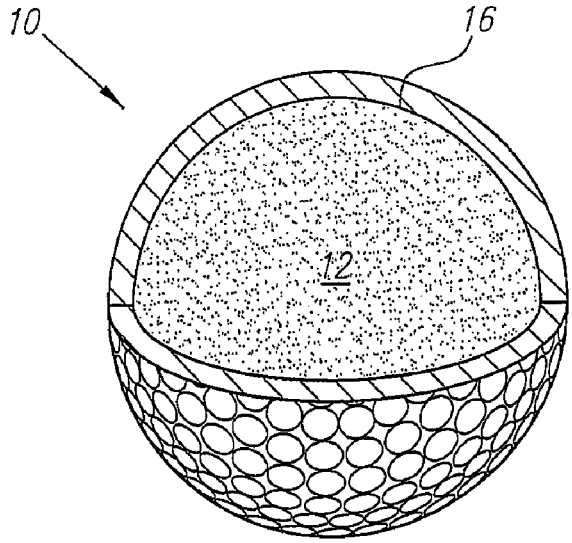
FIG. 2 shows a cross-sectional view of a two-piece golf ball.

Referring now to the drawings, FIG. 1 shows a multi-layer golf ball 10 with a solid core 12, a mantle or inner cover layer 14, and an outer cover layer 16. The outer cover layer 16 is preferably composed of a polyurethane material. Alternatively, the inner cover layer 34 and/or the outer cover layer 36 can comprise ionomer or another conventional golf ball cover material. Such conventional golf ball cover materials typically contain titanium dioxide utilized to make the cover white in appearance. FIG. 2 shows a two-piece golf ball having a cover comprising a polyurethane. The golf ball 10 includes a polybutadiene core 12 and a polyurethane cover 16 preferably formed by RIM.

RIM processes and materials that are useful in forming the golf ball of the present invention are disclosed in the following U.S. Patents, all of which are hereby incorporated by reference in their entireties: U.S. Pat. No. 6,290,614 for a Golf Ball Which Includes Fast-Chemical-Reaction-Produced Component And Method Of Making Same; U.S. Pat. No. 6,533,566 for an Apparatus For Making A Golf Ball; U.S. Pat. No. 6,716,954 for a Golf Ball Formed From A Polyisocyanate Copolymer And Method Of Making Same; U.S. Pat. No. 6,755,634 for an Apparatus For Forming A Golf Ball With Deep Dimples; U.S. Pat. No. 6,776,731 for an Apparatus And Process For Forming A Golf Ball With Deep Dimples; and, U.S. Pat. No. 6,790,149 for a Golf Ball.

The balls shown in FIG. 1 through FIG. 3 may be of a standard, enlarged or reduced size. Further, the core, intermediate and cover components may comprise any number of layers or sub-parts desired.

Golf balls comprising a golf ball component according to the present disclosure are also contemplated. If the component is a cover layer, then a wide array of materials may be used for the cores and mantle layer of the golf ball. For instance, the core and mantle or interior layer materials disclosed in U.S. Pat. Nos. 5,833,553, 5,830,087, 5,820,489 and 5,820,488, all of which are hereby incorporated by reference in their entirety, may be employed. If the component is a core or inner layer, then a variety of conventional materials may be used for one or more cover layers. For instance, the cover layer may employ materials such as disclosed in U.S. Pat. Nos. 6,309,314, 6,277,921, 6,220,972, 6,150,470, 6,126,559, 6,117,025, 5,902,855, 5,895,105, 5,688,869, 5,591,803, and 5,542,677, all of which are hereby incorporated by reference in their entireties.

If the component is a golf ball cover, the golf ball may be a two-piece or multi-layer ball having a wound core, a solid, non-wound core, a liquid core, or a gel core.

One or more intermediate or cover layers can be included having different characteristics. For golf balls for which feel and playability is important, it is particularly advantageous to have an outer cover Shore D hardness of 60 or less, including 50 or less. For golf balls for which lower spin rates and increased distance is important, it is particularly advantageous to have an outer cover Shore D hardness of 60 or more, including 70 or more. These measurements are made in general accordance with ASTM 2240, except they are made on the ball itself and not on a plaque. The outer layer is from about 0.005 to about 0.20 inches in thickness, including about 0.001 to about 0.100 inches in thickness. Thickness is defined as the average thickness of the non-dimpled cover of the outer cover. The cover exhibits good durability characteristics (i.e., groove shear resistance of 3.5 or less ,on a scale of 1 to 6 (lower numbers are better) corresponding to no loss or significant fraying of the cover material, and cut resistance of 3 or less on a scale of 1 to 5 (lower numbers are better) corresponding to a slight dent in the cover not discernible by touch). The groove shear resistance is measured on golf balls struck by a 56 degree wedge clubhead at about 103 feet per second. The cut resistance is measured on golf balls subjected to an off-center blow by a blade with an approximate 5/64" radius attached to a sled weighing approximately 6 lbs dropped from a height of about 42 inches.

The core of the golf ball can be formed of a solid, or an encapsulated sphere filled with a gas, a liquid or a gel, or any other substance that will result in a core or an inner ball (core and a at least one inner cover layer, if the ball is a multi-layer ball), having the desired COR, compression and hardness and other physical properties.

The cores of the golf ball typically have a coefficient of restitution of about 0.750 or more, more preferably 0.770 or more, and a PGA compression of about 125 or less, and more preferably 100 or less. Furthermore, in some applications it may be desirable to provide a core with a coefficient of restitution of about 0.780 to about 0.790 or more. The core used in the golf ball is preferably a solid, but any core type known in the art may be used, such as wound, liquid, hollow, metal, and the like. The term "solid cores" as used herein refers not only to one piece cores but also to those cores having a separate solid layer beneath the covers and over the central core. The cores generally have a weight of about 25 to about 40 grams and preferably about 30 to about 40 grams. Larger and heavier cores, or lighter and smaller cores, may also be used when there is no desire to meet U.S.G.A. or R. & A. standards.

When the golf ball has a solid core, this core can be compression molded from a slug of uncured or lightly cured elastomer composition comprising a high cis content polybutadiene and a metal salt of an α, β, ethylenically unsaturated carboxylic acid such as zinc mono- or diacrylate or methacrylate. To achieve higher coefficients of restitution and/or to increase hardness in the core, the manufacturer may include a small amount of a metal oxide such as zinc oxide. In addition, larger amounts of metal oxide than are needed to achieve the desired coefficient may be included in order to increase the core weight so that the finished ball more closely approaches the U.S.G.A. upper weight limit of 1.620 ounces.

Non-limiting examples of other materials that may be used in the core composition include, but are not limited to, compatible rubbers or ionomers, and low molecular weight fatty acids such as stearic acid. Free radical initiator catalysts such as peroxides may be admixed with the core composition so that on the application of heat and pressure, a curing or cross-linking reaction takes place. The core may also be formed from any other process for molding golf ball cores known in the art.

A thread wound core may comprise a liquid, solid, gel or multi-piece center. The thread wound core is typically obtained by winding a thread of natural or synthetic rubber, or thermoplastic or thermosetting elastomer such as polyurethane, polyester, polyamide, etc., on a solid, liquid, gel or gas filled center to forma thread rubber layer that is then covered with one or more mantle or cover layers. Additionally, prior to applying the cover layer(s), the thread wound core may be further treated or coated with an adhesive layer, protective layer, or any substance that may improve the integrity of the wound core during application of the cover layers and ultimately in usage as a golf ball.

The core, preferably a solid core, is about 1.5 to about 1.6 inches in diameter, although it may be possible to use cores in the range of about 1.0 to about 2.0 inches. If the ball has a single cover layer, the core size may be up to about 1.660 inches. The core 12 of the present invention is preferably a single solid core such as disclosed in U.S. Pat. No. 6,612,940, assigned to Callaway Golf Company and which pertinent parts are hereby incorporated by reference, or such as disclosed in U.S. Pat. No. 6,465,546, also assigned to Callaway Golf Company and which pertinent parts are hereby incorporated by reference. However, alternative embodiments have a non-solid or multiple cores such as disclosed in U.S. Pat. No. 6,663,509, which pertinent parts are hereby incorporated by reference.

The present disclosure includes one or more auxiliary layers disposed on the core, and a preferably immediately adjacent to the outer core surface. For example, for some applications, it may be preferred to deposit a barrier coating that limits transmission of moisture to the core. Such barrier coatings or layers are relatively thin. Generally, such coatings are at least 0.0001 inch, and preferably, at least 0.003 inch in thickness. Furthermore an adhesion promoting layer may be used between the cover layers and/or the core, or the cover and core having a barrier coating disposed thereon. Such adhesion promoting layers are known in the art and may be used in combination with the features described herein. See for example U.S. Pat. No. 5,820,488, which is hereby incorporated by reference.

The inner cover layer that is molded over the core is preferably about 0.0005 inch to about 0.15 inch in thickness. The inner ball that includes the core and inner cover layer(s), or core for a two piece ball, preferably has a diameter in the range of 1.25 to 1.67 inches. The outer cover layer is about 0.0005 inch to about 0.20 inch thick. Together, the core, the inner cover layer(s) and the outer cover layer (or core and single cover layer) combine to form a ball having a diameter of 1.680 inches or more, the minimum diameter permitted by the rules of the U.S.G.A. and weighing no more than 1.62 ounces. If desired, golf balls of different weights and diameters may also be formed if the rules of the U.S.G.A. are not an issue.

In a particular embodiment of the disclosure, the golf ball has a dimple pattern that provides dimple coverage of 65% or more, preferably 75% or more, and ore preferably about 80 to 85% or more In another embodiment, there are from 250 to less than 500 dimples, preferably from about 340 to about 440 dimples. The surface geometry of the golf ball 10 is preferably a conventional dimple pattern such as disclosed in U.S. Pat. No. 6,213,898 for a Golf Ball With An Aerodynamic Surface On A Polyurethane Cover, which pertinent parts are hereby incorporated by reference. Alternatively, the surface geometry of the golf ball 10 may have a non-dimple pattern such as disclosed in U.S. Pat. No. 6,290,615 for A Golf Ball Having Tubular lattice Pattern, which pertinent parts are hereby incorporated by reference.

Specifically, the arrangement and total number of dimples are not critical and may be properly selected within ranges that are well known. For example, the dimple arrangement may be an octahedral, dodecahedral or icosahedral arrangement. The total number of dimples is generally from about 250 to about 600, and especially from about 300 to about 500. The golf balls of the present invention may comprise circular or non-circular dimples or any combination.

In a further embodiment, the golf ball typically is coated with a durable, abrasion-resistant, relatively non-yellowing finish coat or coats if necessary. The finish coat or coats may have some optical brightener and/or pigment added to improve the brightness or whiteness of the finished golf ball.

In one embodiment, from 0.001 to about 10% optical brightener may be added to one or more of the finish coatings. If desired, optical brightener may also be added to the cover materials. One type of preferred finish coatings are solvent based urethane coatings known in the art. It is also contemplated to provide a transparent outer coating or layer on the final finished golf ball.

Golf balls also typically include logos and other markings printed onto the dimpled spherical surface of the ball. Paint, typically clear paint, is applied for the purposes of protecting the cover and improving the outer appearance before the ball is completed as a commercial product. A white coating of one or two layers, typically filled with titanium dioxide of either the anatase or rutile type, may also be utilized.

Fillers are used to adjust the density, flex modulus, mold release, and/or melt flow index of a layer. With some fillers, up to about 200 parts by weight can be used. When the filler is for adjustment of density or flex modulus of a layer, it is present in an amount of at least 5 parts by weight based upon 100 parts by weight of the layer.

A density adjusting filler is used to control the moment of inertia, and thus the initial spin rate of the ball and spin decay. The addition in one or more layers, and particularly in the outer cover layer, of a filler with a lower specific gravity than the resin composition results in a decrease in moment of inertia and a higher initial spin rate than would result if no filler were used. The addition in one or more of the cover layers, and particularly in the outer cover layer, of a filler with a higher specific gravity than the resin composition, results in an increase in moment of inertia and a lower initial spin rate. High specific gravity fillers are preferred as less volume is used to achieve the desired inner or outer cover total weight. Nonreinforcing fillers are also preferred as they have minimal effect on COR. Preferably, the filler does not chemically react with the resin composition to a substantial degree, although some reaction may occur when, for example, zinc oxide is used in a shell layer which contains some ionomer. The filler usually has a specific gravity which is at least 0.05, and in specific embodiments at least 0.1, higher or lower than the specific gravity of the layer composition. In further embodiments, density adjusting fillers are used which have specific gravities which are higher or lower than the specific gravity of the resin composition by 0.2 or more or by 2.0 or more.

A flex modulus adjusting filler is a filler which, e.g. when used in an amount of 1 to 100 parts by weight based upon 100 parts by weight of resin composition, will raise or lower the flex modulus (ASTM D-790) of the resin composition by at least 1% and preferably at least 5% as compared to the flex modulus of the resin composition without the inclusion of the flex modulus adjusting filler.

A mold release adjusting filler is a filler which allows for the easier removal of a part from a mold and eliminates or reduces the need for external release agents which otherwise could be applied to the mold. A mold release adjusting filler typically is used in an amount of up to about 2 weight percent based upon the total weight of the layer.

A melt flow index adjusting filler is a filler which increases or decreases the melt flow, or ease of processing, of the composition.

If the component is a layer, it may contain coupling agents that increase adhesion of materials within a particular layer, e.g. to couple a filler to a resin composition, or between adjacent layers. Non-limiting examples of coupling agents include titanates, zirconates and silanes. Coupling agents typically are used in amounts of 0.1 to 2 weight percent based upon the total weight of the composition in which the coupling agent is included.

Fillers which may be employed in layers other than the outer cover layer may be or are typically in a finely divided form, for example, in a size generally less than about 20 mesh, preferably less than about 100 mesh U.S. standard size, except for fibers and flock, which are generally elongated. Flock and fiber sizes should be small enough to facilitate processing. Filler particle size will depend upon desired effect, cost, ease of addition, and dusting considerations. The filler preferably is selected from the group consisting of precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates, metals, metal alloys, tungsten carbide, metal oxides, metal stearates, particulate carbonaceous materials, micro balloons, and combinations thereof.

Specific embodiments of the disclosure will now be described in detail. These examples are intended to be illustrative, and the disclosure is not limited to the materials, conditions, or process parameters set forth in these embodiments. All parts and percentages are by weight unless otherwise indicated.

In an alternative embodiment of a golf ball 20, the boundary layer 16 or cover layer 14 is comprised of a high acid (i.e. greater than 16 weight percent acid) ionomer resin or high acid ionomer blend. More preferably, the boundary layer 16 is comprised of a blend of two or more high acid (i.e. greater than 16 weight percent acid) ionomer resins neutralized to various extents by different metal cations.

In an alternative embodiment of a golf ball 20, the boundary layer 16 or cover layer 14 is comprised of a low acid (i.e. 16 weight percent acid or less) ionomer resin or low acid ionomer blend. Preferably, the boundary layer 16 is comprised of a blend of two or more low acid (i.e. 16 weight percent acid or less) ionomer resins neutralized to various extents by different metal cations. The boundary layer 16 compositions of the embodiments described herein may include the high acid ionomers such as those developed by E. I. DuPont de Nemours & Company under the SURLYN brand, and by Exxon Corporation under the ESCOR or IOTEK brands, or blends thereof. Examples of compositions which may be used as the boundary layer 16 herein are set forth in detail in U.S. Pat. No. 5,688,869, which is hereby incorporated by reference in its entirety. Of course, the boundary layer 16 high acid ionomer compositions are not limited in any way to those compositions set forth in said patent. Those compositions are incorporated herein by way of examples only.

The high acid ionomers which may be suitable for use in formulating the boundary layer 16 compositions are ionic copolymers which are the metal (such as sodium, zinc, magnesium, etc.) salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (for example, iso- or n-butylacrylate, etc.) can also be included to produce a softer terpolymer. The carboxylic acid groups of the copolymer are partially neutralized (for example, approximately 10-100%, preferably 30-70%) by the metal ions. Each of the high acid ionomer resins which may be included in the inner layer cover compositions of the invention contains greater than 16% by weight of a carboxylic acid, preferably from about 17% to about 25% by weight of a carboxylic acid, more preferably from about 18.5% to about 21.5% by weight of a carboxylic acid. Examples of the high acid methacrylic acid based ionomers found suitable for use in accordance with this invention include, but are not limited to, SURLYN 8220 and 8240 (both formerly known as forms of SURLYN AD-8422), SURLYN 9220 (zinc cation), SURLYN SEP-503-1 (zinc cation), and SURLYN SEP-503-2 (magnesium cation). According to DuPont, all of these ionomers contain from about 18.5 to about 21.5% by weight methacrylic acid. Examples of the high acid acrylic acid based ionomers suitable for use in the present invention also include, but are not limited to, the high acid ethylene acrylic acid ionomers produced by Exxon such as Ex 1001, 1002, 959, 960, 989, 990, 1003, 1004, 1006,1007, 993, and 994. In this regard, ESCOR or IOTEK 959 is a sodium ion neutralized ethylene-acrylic neutralized ethylene-acrylic acid copolymer. According to Exxon, IOTEKS 959 and 960 contain from about 19.0 to about 21.0% by weight acrylic acid with approximately 30 to about 70 percent of the acid groups neutralized with sodium and zinc ions, respectively.

Furthermore, as a result of the previous development by the assignee of this application of a number of high acid ionomers neutralized to various extents by several different types of metal cations, such as by manganese, lithium, potassium, calcium and nickel cations, several high acid ionomers and/or high acid ionomer blends besides sodium, zinc and magnesium high acid ionomers or ionomer blends are also available for golf ball cover production. It has been found that these additional cation neutralized high acid ionomer blends produce boundary layer 16 compositions exhibiting enhanced hardness and resilience due to synergies which occur during processing. Consequently, these metal cation neutralized high acid ionomer resins can be blended to produce substantially higher C.O.R.'s than those produced by the low acid ionomer boundary layer 16 compositions presently commercially available.

More particularly, several metal cation neutralized high acid ionomer resins have been produced by the assignee of this invention by neutralizing, to various extents, high acid copolymers of an alpha-olefin and an alpha, beta-unsaturated carboxylic acid with a wide variety of different metal cation salts. It has been found that numerous metal cation neutralized high acid ionomer resins can be obtained by reacting a high acid copolymer (i.e. a copolymer containing greater than 16% by weight acid, preferably from about 17 to about 25 weight percent acid, and more preferably about 20 weight percent acid), with a metal cation salt capable of ionizing or neutralizing the copolymer to the extent desired (for example, from about 10% to 90%).

The base copolymer is made up of greater than 16% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with ethylene methacrylic acid being preferred.

The softening comonomer that can be optionally included in the boundary layer 16 of the golf ball of the invention may be selected from the group consisting of vinyl esters of aliphatic carboxylic acids wherein the acids have 2 to 10 carbon atoms, vinyl ethers wherein the alkyl groups contain 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high acid ionomers included in the present invention include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, etc. The base copolymer broadly contains greater than 16% by weight unsaturated carboxylic acid, from about 39 to about 83% by weight ethylene and from 0 to about 40% by weight of a softening comonomer. Preferably, the copolymer contains about 20% by weight unsaturated carboxylic acid and about 80% by weight ethylene. Most preferably, the copolymer contains about 20% acrylic acid with the remainder being ethylene.

The boundary layer 16 compositions may include the low acid ionomers such as those developed and sold by E. I. DuPont de Nemours & Company under the SURLYN and by Exxon Corporation under the brands ESCOR and IOTEK, ionomers made in-situ, or blends thereof.

Another embodiment of the boundary layer 16 comprises a non-ionomeric thermoplastic material or thermoset material. Suitable non-ionomeric materials include, but are not limited to, metallocene catalyzed polyolefins or polyamides, polyamide/ionomer blends, polyphenylene ether/ionomer blends, etc., which preferably have a Shore D hardness of at least 60 (or a Shore C hardness of at least about 90) and a flex modulus of greater than about 30,000 psi, preferably greater than about 50,000 psi, or other hardness and flex modulus values which are comparable to the properties of the ionomers described above. Other suitable materials include but are not limited to, thermoplastic or thermosetting polyurethanes, thermoplastic block polyesters, for example, a polyester elastomer such as that marketed by DuPont under the brand HYTREL, or thermoplastic block polyamides, for example, a polyether amide such as that marketed by Elf Atochem S. A. under the brand PEBEX, a blend of two or more non-ionomeric thermoplastic elastomers, or a blend of one or more ionomers and one or more non-ionomeric thermoplastic elastomers. These materials can be blended with the ionomers described above in order to reduce cost relative to the use of higher quantities of ionomer.

Additional materials suitable for use in the boundary layer 16 or cover layer 14 of the present invention include polyurethanes. These are described in more detail below.

The cover layer 14 preferably has a thickness in the range of 0.005 inch to about 0.15 inch, more preferably about 0.010 inch to about 0.030 inch, and most preferably 0.010 inch to 0.020 inch.

The cover layer 14 preferably comprises a polyurethane/polyurea with a Shore D hardness (plaque) of from about 50 to about 75, more preferably from about 60 to about 70, and most preferably from about 64.

A preferred quasi-prepolymer of the isocyanate component is ISONATE 181 prepolymer available from Dow Plastics(Mondur PF from Bayer may also be used). ISONATE 181 is a diphenylmethane diisocyanate with glycol (typically diethylene glycol). ISONATE has a nitrogen-oxygen-carbon ("NCO") group content of approximately 23.

A preferred diethyl-2,4-toluene-diamine is available from Albemarle Corporation of Baton Rouge, La. under the tradename ETHACURE® 100 or EHTACURE® 100 LC.

A preferred pigment material is PLASTICOLORS DR-10368.

A preferred polytetramethylene ether glycol of the poly component is TERATHANE® 1000 polyether glycol from DuPont Chemical (PolyTHF 1000 and 2000 from BASF may also be used). TERATHANE® 1000 polyether glycol is a polytetramethylene ether glycol which has a molecular weight of approximately 1000. Another preferred polytetramethylene ether glycol of the poly component is TERATHANE® 2000 polyether glycol from DuPont Chemical. TERATHANE® 2000 polyether glycol is a polytetramethylene ether glycol which has a molecular weight of approximately 2000.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball comprising:

a cover layer;

a coating layer disposed over the cover layer, the coating layer comprising a first chemical component comprising a first polyol, a second polyol and a third polyol, n-butyl acetate, methyl amyl ketone, methyl isobutyl ketone, titanium dioxide, UV absorber and acrylate additives, wherein the first polyol is a high equivalent weight polyester polyol, the second polyol is a saturated polyester polyol, and the third polyol is a saturated polyester polyol, and a second chemical component comprising methyl isobutyl ketone and an isocyanate compound.

2. The golf ball according to claim 1 wherein a mix ratio of the first component to the second component is three to one by volume.

3. The golf ball according to claim 1 wherein a mix ratio of the first component to the second component is four to one by mass.

4. The golf ball according to claim 1 wherein the isocyanate compound is a hexamethylene diisocyanate.

5. The golf ball according to claim 1 wherein the isocyanate compound has a nitro-carbon-oxygen content of approximately 23%.

6. The golf ball according to claim 1 wherein the cover layer is composed of a polyurethane material.

7. The golf ball according to claim 1 wherein the cover layer is composed of a reaction injection molded polyurethane material.

8. The golf ball according to claim 1 wherein the cover layer has a thickness ranging from 0.010 inch to 0.040 inch.

9. The golf ball according to claim 1 wherein the cover layer has a thickness ranging from 0.010 inch to 0.025 inch.

10. The golf ball according to claim 1 further comprising a core and a boundary layer, the cover layer disposed over the boundary layer.

11. The golf ball according to claim 1 wherein the coating layer has a low modulus.

12. A golf ball comprising:

a core;

a cover layer disposed over the core, the cover layer composed of a polyurethane material;

a coating layer disposed over the cover layer, the coating layer comprising a first chemical component comprising a first polyol, a second polyol and a third polyol, n-butyl acetate, methyl amyl ketone, methyl isobutyl ketone, titanium dioxide, UV absorber and acrylate additives, wherein the first polyol is a high equivalent weight polyester polyol, the second polyol is a saturated polyester polyol, and the third polyol is a saturated polyester polyol, the first chemical component having a mass of 160 grams, and a second chemical component comprising methyl isobutyl ketone and an isocyanate compound, the second chemical component having a mass of 40 grams.

* * * * *